US005146433A

United States Patent [19]

Kosmala et al.

[11] Patent Number: 5,146,433

[45] Date of Patent: Sep. 8, 1992

[54] MUD PUMP NOISE CANCELLATION SYSTEM AND METHOD

[75] Inventors: Alexandre Kosmala, Aberdeen, Scotland; David Malone, Sugar Land; Peter Masak, Katy, both of Tex.

[73] Assignee: Anadrill, Inc., Sugar Land, Tex.

[21] Appl. No.: 770,198

[22] Filed: Oct. 2, 1991

[51] Int. Cl.[5] ..... G01J 1/40

[52] U.S. Cl. ..... 367/83; 367/43

[58] Field of Search ..... 367/43, 83, 84, 85; 364/422

[56] References Cited

U.S. PATENT DOCUMENTS

| | | | |
|---|---|---|---|
| 3,302,457 | 2/1967 | Meyes | 367/83 |
| 3,488,629 | 1/1970 | Claycomb | 367/83 |
| 3,555,504 | 1/1971 | Fields | 367/83 |
| 3,716,830 | 2/1973 | Garcia | 367/83 |
| 4,215,425 | 7/1980 | Wqggener | 367/83 |
| 4,215,427 | 7/1980 | Waggener et al. | 367/83 |
| 4,262,343 | 4/1981 | Claycomb | 367/83 |
| 4,590,593 | 5/1986 | Rodney | 367/83 |
| 4,642,800 | 2/1987 | Umeda | 367/85 |
| 4,692,911 | 9/1987 | Scherbatskoy | 367/83 |
| 4,878,206 | 10/1989 | Grosso et al. | 367/83 |

*Primary Examiner*—Ian J. Lobo

*Attorney, Agent, or Firm*—David P. Gordon; John J. Ryberg

[57] ABSTRACT

Methods for recovering a LWD or MWD data signal in the presence of mud pump noise are provided and generally comprise calibrating the drilling mud pressure as a function of the mud pump piston position, and then tracking the piston position during transmission of the LWD or MWD data signal and using the calibration information to subtract out the mud pump noise. Calibration is accomplished in the absence of the LWD or MWD data signal to provide a correlation between mud pump piston position and the drilling mud pressure. Then, when the LWD or MWD data signal is being generated, the mud pump piston position is tracked such that the pressure due to the pump can be subtracted and the LWD or MWD signal recovered. Where a plurality of mud pumps are being utilized, calibration is accomplished by running the mud pumps together in the absence of the LWD or MWD data signal, and processing the received mud pressure signals in the Fourier domain to allocate respective portions of the mud pressure signals to respective mud pumps such that each mud pump is provided with a signature as a function of its own piston position. With the piston position of each mud pump being tracked, the sum of the mud pressure signals generated by the mud pumps based on their piston positions is subtracted from the total received signal to recover the LWD or MWD signal.

20 Claims, 15 Drawing Sheets

MUD PUMP NOISE CANCELLATION SYSTEM AND METHOD

BACKGROUND OF THE INVENTION

1. Field of the Invention

This invention relates to communication systems, and more particularly, to systems and methods for receiving and interpreting data signals being transmitted to the surface of the earth in a logging-while-drilling system.

2. Prior Art

Logging-while-drilling (LWD) or measurement-while-drilling (MWD) involves the transmission to the earth's surface of downhole measurements taken during drilling. The measurements are generally taken by instruments mounted within drill collars above the drill bit. Indications of the measurements must then be transmitted uphole to the earth's surface. Various schemes have been proposed for achieving transmission of measurement information to the earth's surface. For example, one proposed technique transmits logging measurements by means of insulated electrical conductors extending through the drill string. This scheme, however, requires adaptation of drill string pipes including expensive provision for electrical connections at the drill pipe couplings. Another proposed scheme employs an acoustic wave that is generated downhole and travels upward through the metal drill string; but the high levels of interfering noise in a drill string are a problem in this technique.

The most common scheme for transmitting measurement information utilizes the drilling fluid within the borehole as a transmission medium for acoustic waves modulated to represent the measurement information. Typically, drilling fluid or "mud" is circulated downward through the drill string and drill bit and upward through the annulus defined by the portion of the borehole surrounding the drill string. The drilling fluid not only removes drill cuttings and maintains a desired hydrostatic pressure in the borehole, but cools the drill bit. In a species of the technique referred to above, a downhole acoustic transmitter known as a rotary valve or "mud siren", repeatedly interrupts the flow of the drilling fluid, and this causes a varying pressure wave to be generated in the drilling fluid at a frequency that is proportional to the rate of interruption. Logging data is transmitted by modulating the acoustic carrier as a function of the downhole measured data.

One difficulty in transmitting measurement information via the drilling mud is that the signal received is typically of low amplitude relative to the noise generated by the mud pumps which circulate the mud, as the downhole signal is generated remote from the uphole sensors while the mud pumps are close to the uphole sensors. In particular, where the downhole tool generates a pressure wave that is phase modulated to encode binary data, such as is disclosed in U.S. Pat. No. 4,847,815 and assigned to the assignee hereof, and where the periodic noise sources are at frequencies which are at or near the frequency of the carrier wave (e.g. 12 Hz), difficulties arise.

Mud pumps are large positive displacement pumps which generate flow by moving a piston back and forth within a cylinder while simultaneously opening and closing intake and exhaust valves. A mud pump typically has three pistons attached to a common drive shaft. These pistons are one hundred and twenty degrees out of phase with one another to minimize pressure variations. Mud pump noise is caused primarily by pressure variations while forcing mud through the exhaust valve.

The fundamental frequency in Hertz of the noise generated by the mud pumps is equal to the strokes per minute of the mud pump divided by sixty. Due to the physical nature and operation of mud pumps, harmonics are also generated, leading to noise peaks of varying amplitude at all integer values of the fundamental frequency. The highest amplitudes generally occur at integer multiples of the number of pistons per pump times the fundamental frequency, e.g., 3F, 6F, 9F, etc. for a pump with three pistons.

Mud pumps are capable of generating very large noise peaks if pump pressure variations are not dampened. Thus, drilling rigs are typically provided with pulsation dampeners at the output of each pump. Despite the pulsation dampeners, however, the mud pump noise amplitude is typically much greater than the amplitude of the signal being received from the downhole acoustic transmitter. To reduce or eliminate the mud pump noise so that the downhole signal can be recovered, different techniques have been proposed, such as may be found in U.S. Pat. Nos. 3,488,629 to Claycomb, 3,555,504 to Fields, 3,716,830 to Garcia, 4,215,425 to Waggener, 4,215,427 to Waggener et al., 4,262,343 to Claycomb, 4,590,593 to Rodney, and 4,642,800 to Umeda. What is common to all of the techniques is that they try to eliminate the mud pump noise by adding the mud pump noise to an inverted version of itself. Most of the techniques utilize two sensors in the mud stream (usually two pressure sensors) and take the difference of signals in an attempt to cancel the mud pump noise without canceling the data signal. Various of the techniques require particular physical arrangements.

The Umeda U.S. Pat. No. 4,642,800 takes a slightly different approach to eliminating mud pump noise. Umeda teaches that an average pump signature may be found by obtaining the pump signatures in the presence of data over a certain number of pump cycles. The updated average pump signature is corrected by interpolation to match the current pump cycle length and is subtracted from the current pump signature to provide the residual data signal. While the technique disclosed in Umeda may be effective for particular arrangements, it has several drawbacks. First, because Umeda averages pump signatures which include data pulses, unless the effect of the data signal over any averaging period is zero (i.e. non-carrier frequency systems), the data signal which is to be recovered will tend to be undesirably subtracted from itself. Second, because Umeda uses only a single strobe per pump cycle, estimates (e.g. interpolations) are utilized which can introduce significant error. Third, Umeda does not disclose in detail how to treat a multi-pump system. In particular, if Umeda assumes that the pump signature for each pump of a multi-pump system is the same as it would be for a single pump system, large errors are introduced in attempting to cancel out the pump noise, as pumps which are working in multi-pump systems will have different signatures than they would it they were working in a single pump system. In addition, because estimates are required for each pump in the multi-pump system, additional error in the multi-pump system is introduced.

SUMMARY OF THE INVENTION

It is therefore an object of the invention to provide methods and systems for accurately recovering data signals introduced into drilling mud in the presence of mud pump noise.

It is another object of the invention to provide methods and systems for accurately recovering logging-while-drilling (LWD) or measurement-while-drilling (MWD) information which is modulated in drilling mud by correlating mud pump piston positions to a mud pressure signature in a calibration procedure.

It is a further object of the invention to provide methods and systems for accurately obtaining LWD or MWD information in multiple mud pump systems by allocating noise attributable to each mud pump and by tracking the mud pump piston position of each mud pump.

Another object of the invention is to provide method and systems for recovering LWD or MWD information transmitted through drilling mud by varying the pressure of the drilling mud regardless of the manner in which the information is coded.

In accord with the objects of the invention, methods for recovering a LWD or MWD data signal in the presence of mud pump noise are provided, and generally comprise calibrating the drilling mud pressure as a function of the mud pump piston position, and then tracking the piston position during transmission of the LWD or MWD data signal and using the calibration information to subtract out the mud pump noise. More particularly, calibration is accomplished in the absence of the LWD or MWD data signal to provide a correlation between mud pump piston position and the drilling mud pressure; i.e., the pressure signature as a function of mud pump piston position is obtained. Then, when the LWD or MWD data signal is being provided, the mud pump piston position is tracked such that the pressure due to the pump can be subtracted; i.e., by knowing the mud pump piston position, the pressure due to the mud pump is found and subtracted from the total received signal to provide the LWD or MWD signal. Where a plurality of mud pumps are used, calibration is accomplished by running the mud pumps together in the absence of the LWD or MWD data signal, and processing the received mud pressure signals in the Fourier domain to allocated respective portions of the mud pressure signals to respective mud pumps such that each mud pump is provided with a signature as a function of its own piston position. With the piston position of each mud pump being tracked, the sum of the mud pressure signals generated by the mud pumps based on their piston positions is subtracted from the total received signal to provide the LWD or MWD signal.

According to a preferred aspect of the invention, the calibration procedure is periodically repeated, e.g., each time additional pipe is added to the drill string, thereby eliminating the effects of depth and mud property variation on the system.

A better understanding of the invention, and additional objects and advantages of the invention will become evident to those skilled in the art upon reference to the detailed description taken in conjunction with the accompanying drawings.

DETAILED DESCRIPTION OF THE PREFERRED EMBODIMENT

Figure 1:
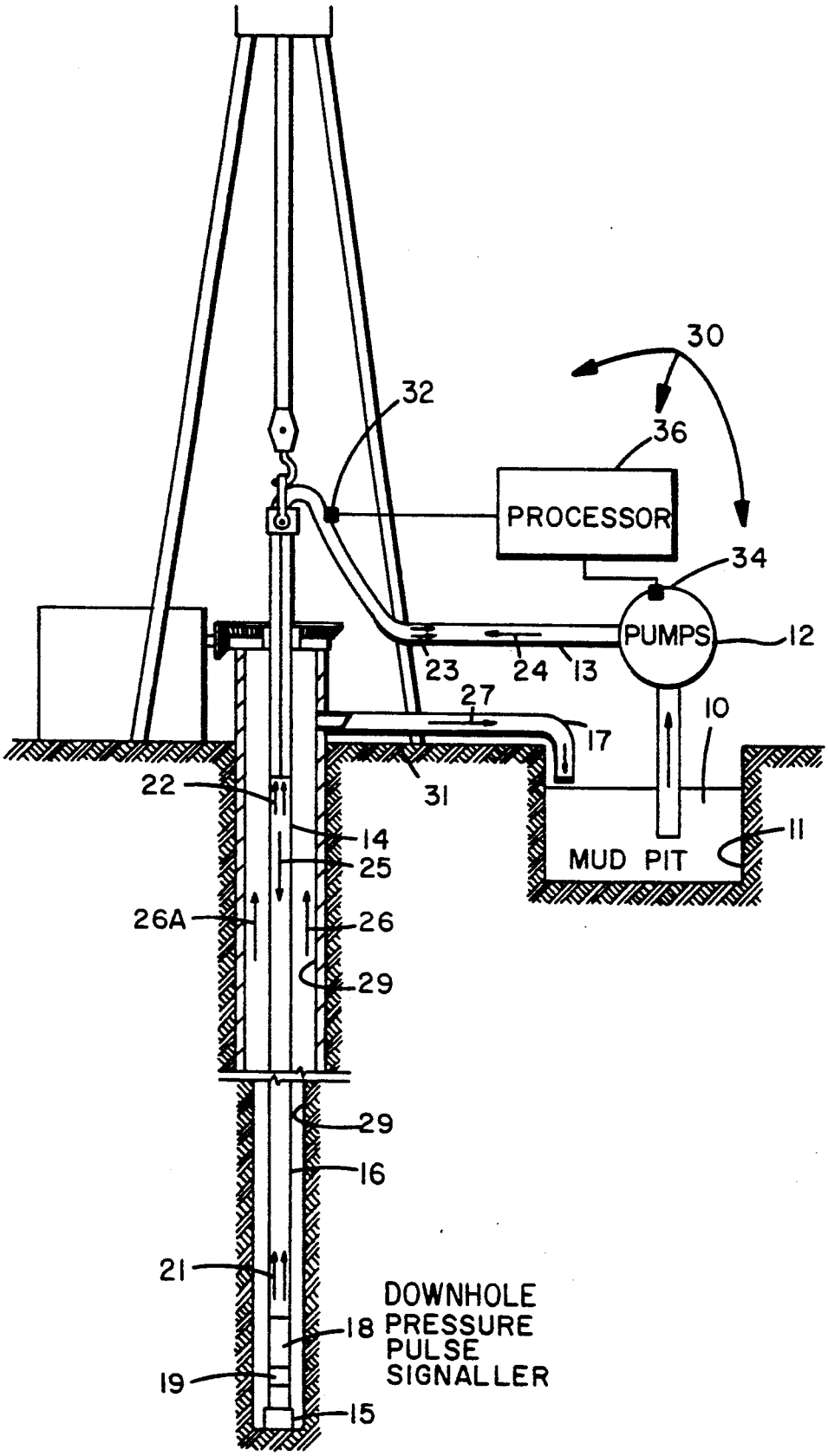
FIG. 1 is a schematic diagram showing the present invention in use in conjunction with a downhole pressure pulse signaling device.

Referring to FIG. 1, the operation of the present invention in a typical drilling arrangement is illustrated schematically. Drilling mud 10 is picked up from mud pit 11 by one or more mud pumps 12 which are typically of the piston reciprocating type. The mud 10 is circulated through mud line 13, down through the drill string 14, through the drill bit 15, and back to the surface of the formation via the annulus 16 between the drill stem and the wall of the well bore 29. Upon reaching the earth's surface 31, the mud is discharged through line 17 back into the mud pit 11 where cuttings of rock or other well debris are allowed to settle out before the mud is recirculated.

A downhole pressure pulse signaling device 18 is incorporated in the drill string for transmission of data signals derived during the drilling operation by the measurement instrument package 19. Signaling device 18 may be of the valve or variable orifice type which generates pressure pulses in the drilling fluid by varying the speed of flow. A preferred signaling device which generates sinusoidal signals is disclosed in U.S. Pat. No. 4,847,815 assigned to the assignee hereof. Data signals are encoded in a desired form by appropriate electronic means in the downhole tool. Arrows 21, 22, and 23 illustrate the path taken by the pressure pulses provided by the downhole signaling device 18 under typical well conditions. Pump 12 also produces pressure pulses in the mud line 13 and these are indicated by arrows, 24, 25, 26 and 26*a* which also illustrate the flow of the mud through the annulus 16.

In order for the downhole pressure pulse signals to be recoverable at the surface, some means must be provided to remove or substantially eliminate the portion of the mud pressure signal due to the mud pumps. Subsystem 30, including pressure transducer 32, mud pump piston position sensors 34, and computer or processor 36, comprises such a means.

Figure 2A:
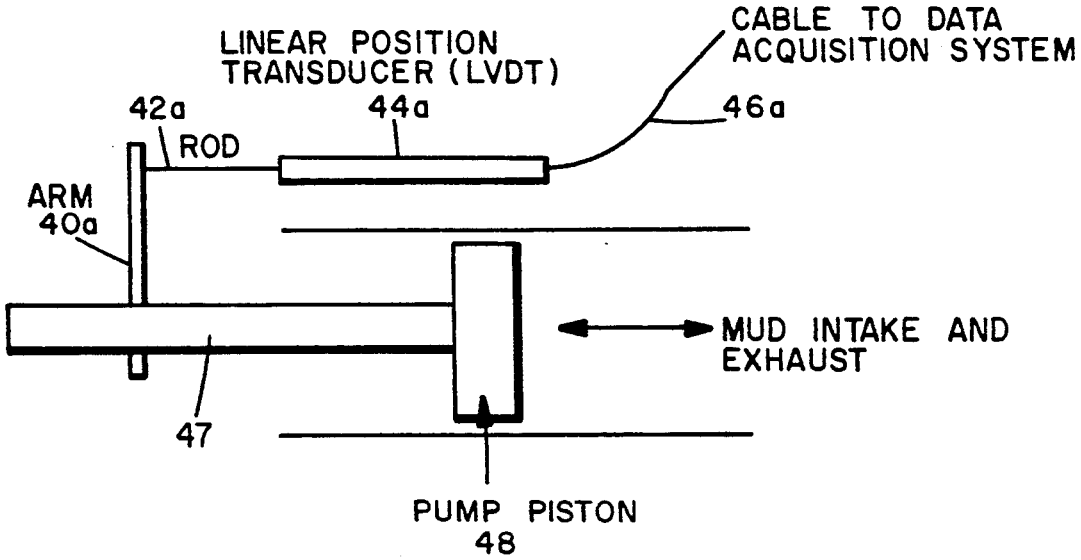
FIGS. 2*a* and 2*b* are schematic diagrams of exemplary mud pump piston position sensors utilized in practicing the invention.
Figure 2B:
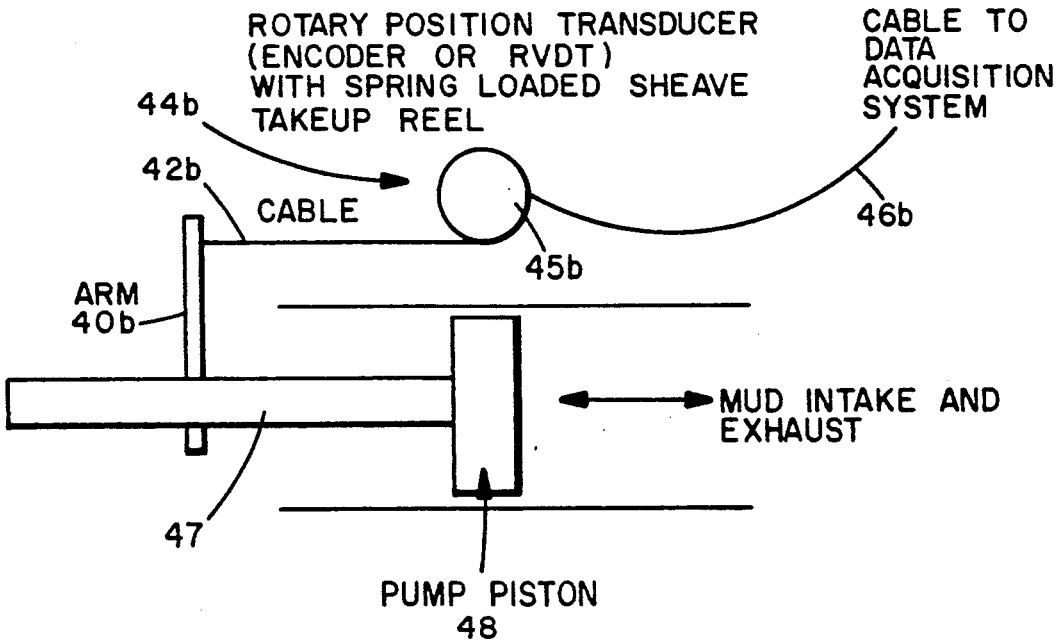

The preferred pressure transducer 32 of subsystem 30 is a piezoelectric pressure transducer which provides an analog signal which is preferably bandpass filtered by a filter (not shown) or by the computer 36. The preferred mud pump piston position sensor 34 may either comprise an LVDT which utilizes a linear position transducer, or an RVDT which utilizes a rotary position transducer. The LVDT, as shown in FIG. 2*a*, has an arm 40*a*, a rod 42*a*, and a linear position transducer 44*a* with leads 46*a*. Arm 40*a* is coupled to one of the piston rods 47 of the mud pump 12 as well as to rod 42*a* of the LVDT. Rod 42*a* moves coaxially within the linear position transducer 44*a*, which provides a high precision digital indication of the location of piston 48 in the mud pump 12. The RVDT, as shown in FIG. 2*b*, has an arm 40*b*, a cable 42*b*, and an encoder or rotary position transducer 44*b* with a spring loaded sheave takeup reel 45*b*. The RVDT also includes leads 46*b*. Arm 40*b* of the RVDT of FIG. 2*b* is coupled to one of the piston rods 47 of the mud pump 12 as well as to the cable 42*b* of the RBDT. As arm 40*b* moves with the pump piston rod 47, the cable 42*b* is let out or reeled onto the takeup reel 45*b* takeup reel. The rotation of the takeup reel 45*b* provides a high precision digital indication of the location of piston 48 in the mud pump 12.

Figure 3:
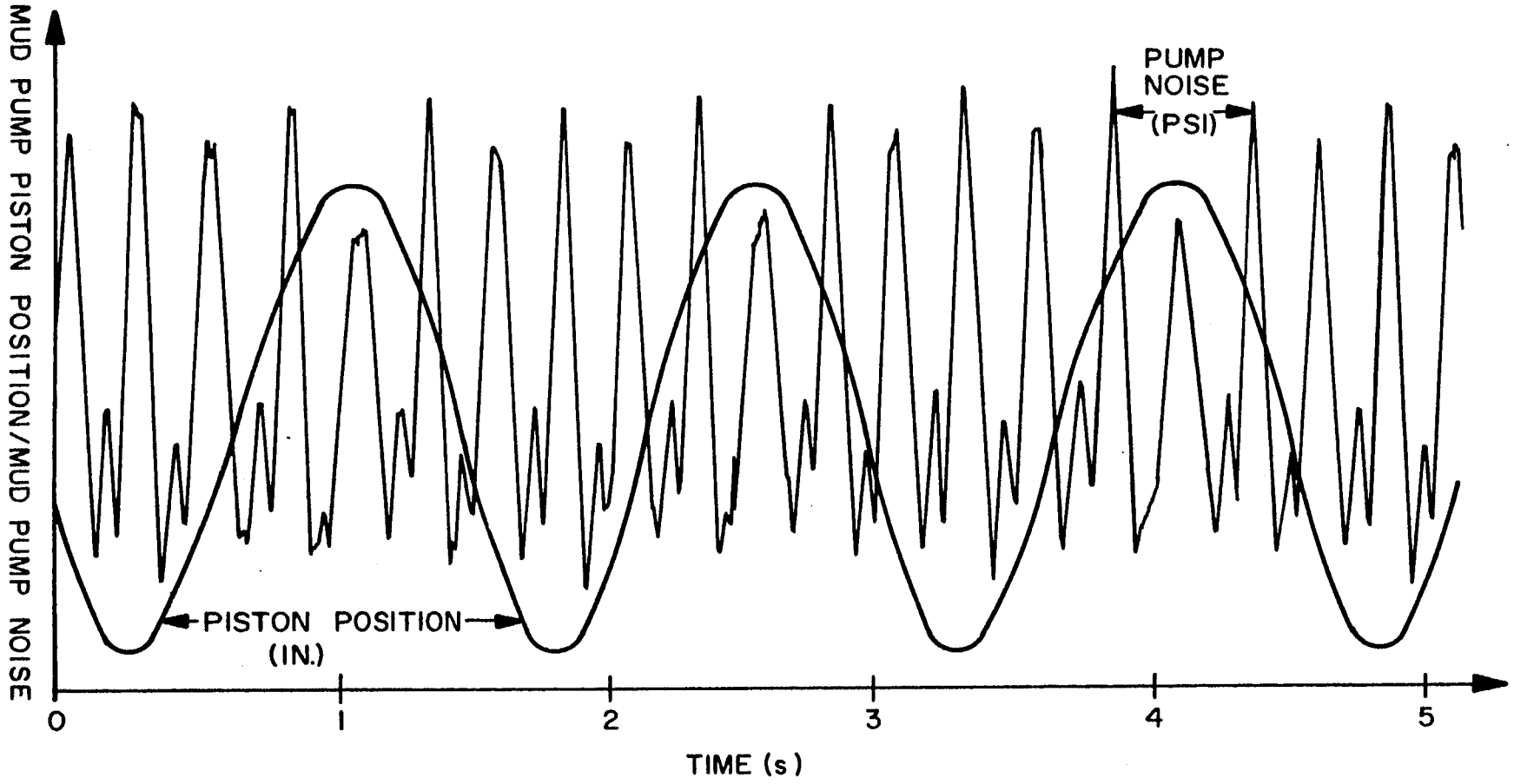
FIG. 3 is a graph illustrating how mud pump piston position correlates to mud pump noise for a given set of operating conditions.

Testing has shown that the drilling mud pressure generated by the mud pump 12 is determined by the position of the mud pump piston for a given set of operating conditions. FIG. 3 illustrates how mud pump piston position correlates to mud pump noise. By coupling the linear position transducer 44*a* or rotary position transducer 44*b* to the piston rod 47 of the mud pump, a calibration can be performed that measures the pressure generated as a function of piston position.

Figure 4:
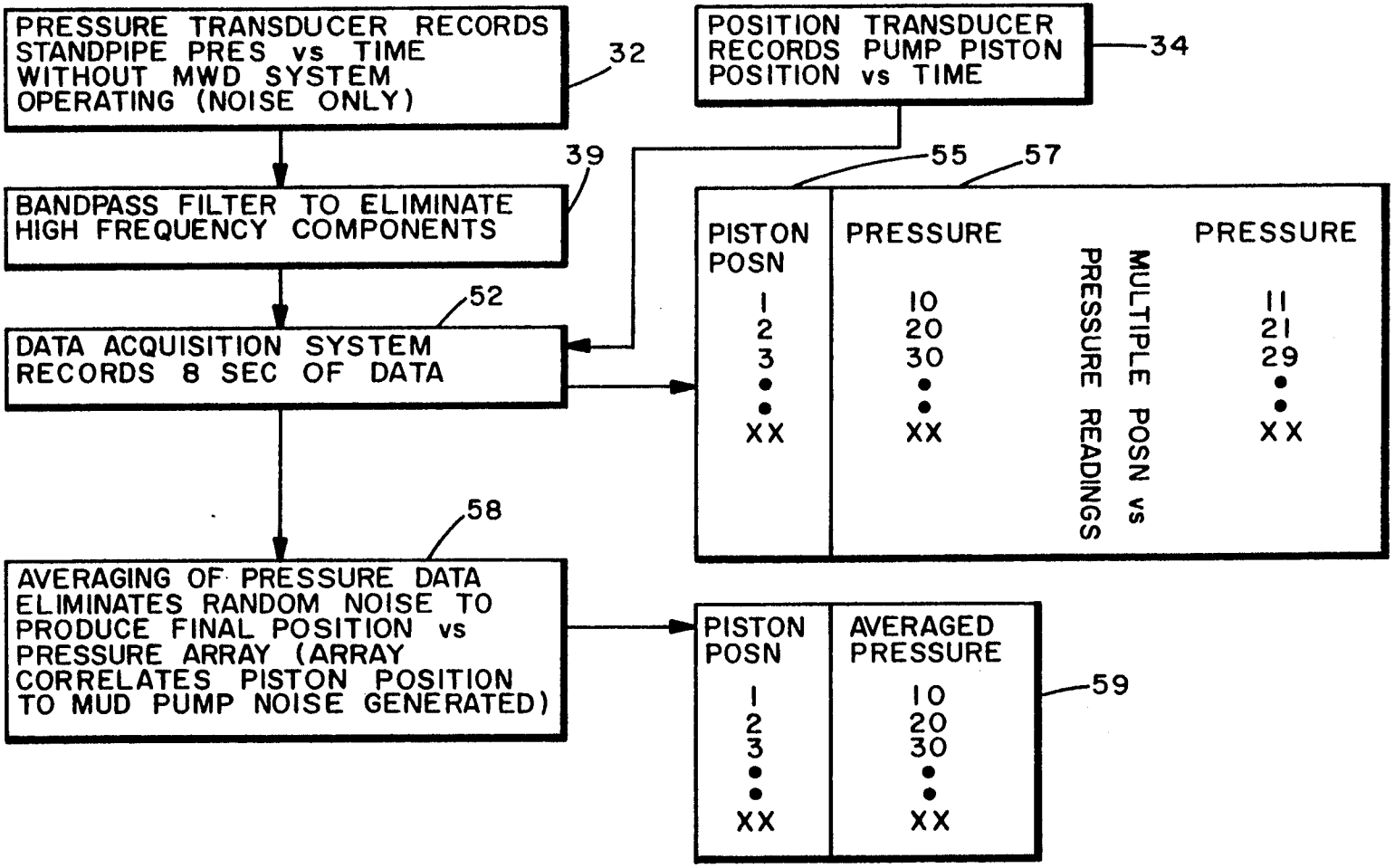
FIG. 4 is a flow chart of the mud pump calibration procedure for a system utilizing one mud pump.

The preferred calibration procedure for correlating mud pressure generated as a function of piston position for a single mud pump system is seen in FIG. 4. After the pump noise stabilizes in the system, and before the LWD and MWD tool turns on (i.e. before the data signal starts), the signals output by the position sensor 34 and the signals output by the pressure transducer 32 which are bandpass filtered at 39 are preferably recorded at 52 as related position and pressure arrays 55, 57 in the computer (e.g. in computer memory). Preferably, approximately eight seconds of data (e.g., five to ten pump cycles) are accumulated. Then, averages of the pressure as a function of position are calculated (thereby reducing random pressure variations) at 58 to produced a single position vs. pump noise calibration array 59. Indications of the average calibration array or the inverse thereof are stored and used for canceling mud pump noise as is hereinafter described.

Figure 5:
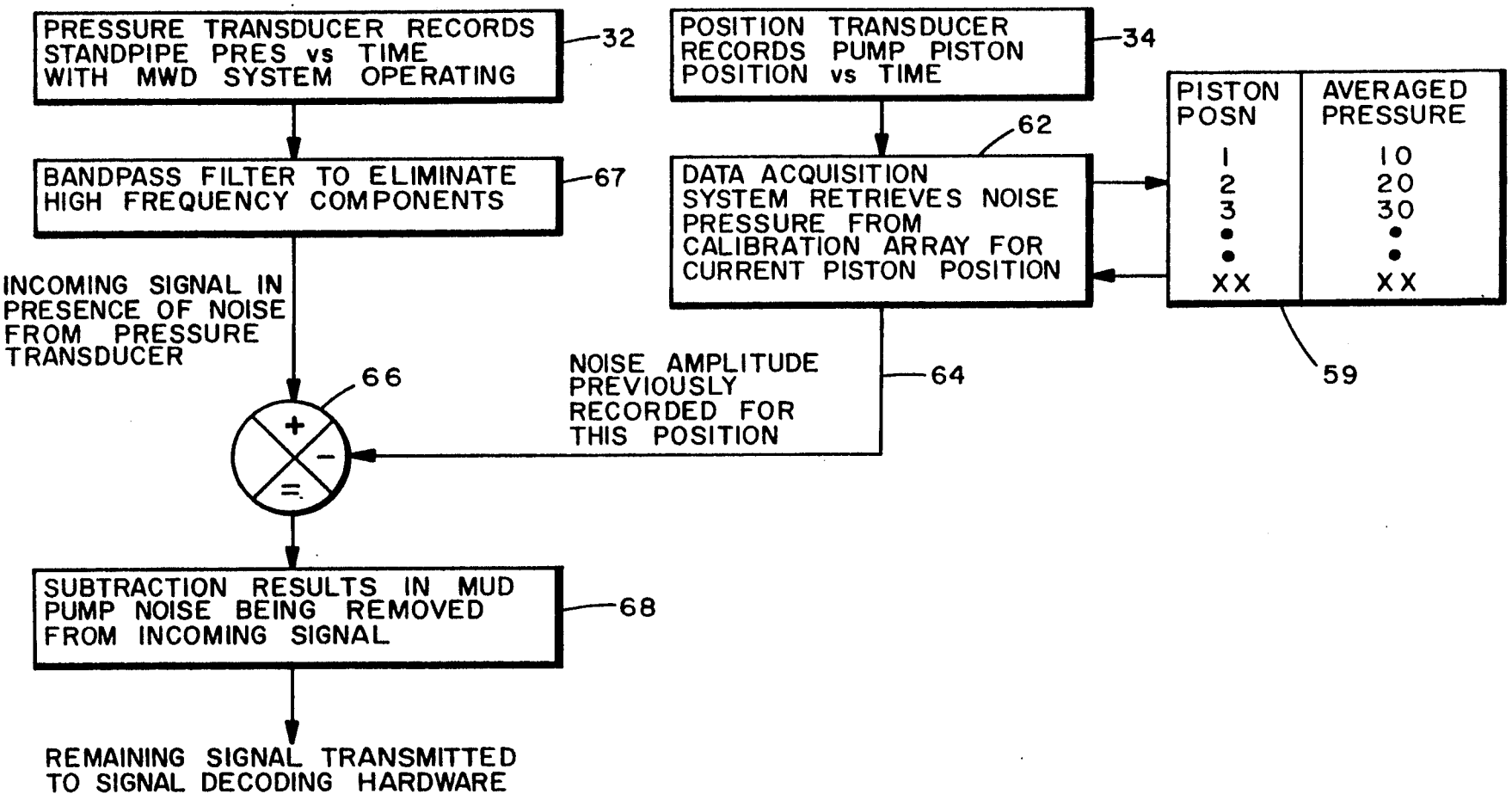
FIG. 5 is a flow chart of the noise cancellation procedure for a system utilizing one mud pump.

The noise cancellation procedure according to the invention is set forth in FIG. 5. Upon the turning on of the downhole tool and the transmission of LWD or MWD data (hereinafter referred to simply as LWD data for sake of brevity), the position sensor 34 and pressure transducer 32 continue to provide indications of piston location and mud pressure; except that the piston position data is used in real time to determine the electrical signal (based on the calibration array 59) which must be subtracted from the composite LWD/noise signal to cancel the noise component of the signal and leave only the LWD signal. Thus, as shown in FIG. 5, the position sensor signal is sampled at 62 (i.e. based on the position sensor signal, the average calibration array is accessed and a corresponding pump noise is provided), and the corresponding pump noise pressure 64 is subtracted at 66 from the real time sensed pressure 32 which was bandpass filtered at 67 to eliminate high frequency components. The difference between the real time sensed pressure and the pump noise pressure provides an indication of the LWD data signal 68.

Figure 6A:
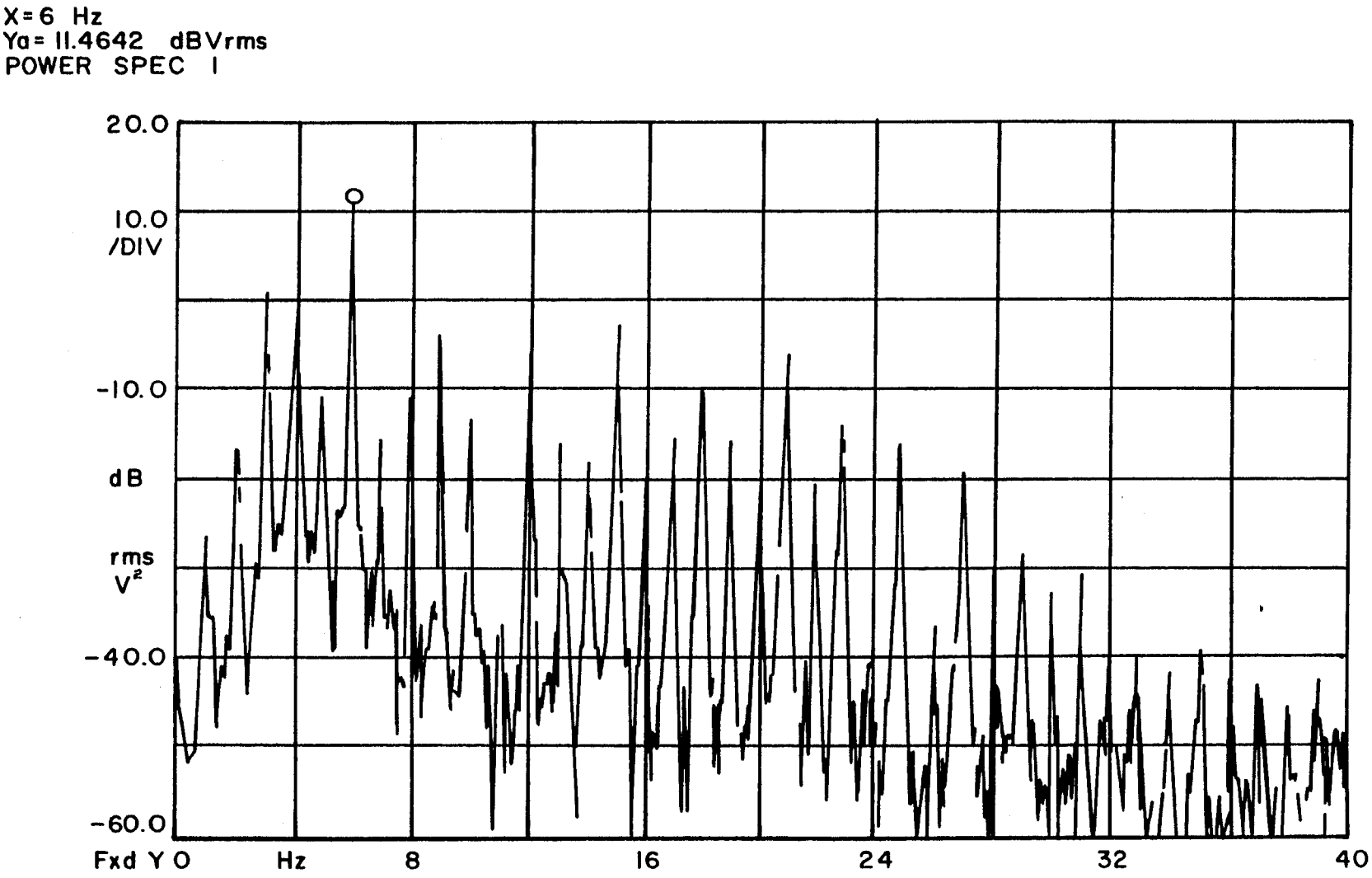
FIGS 6*a* and 6*b* are respectively mud pump noise signals prior to and after noise cancellation in a one pump system.
Figure 6B:
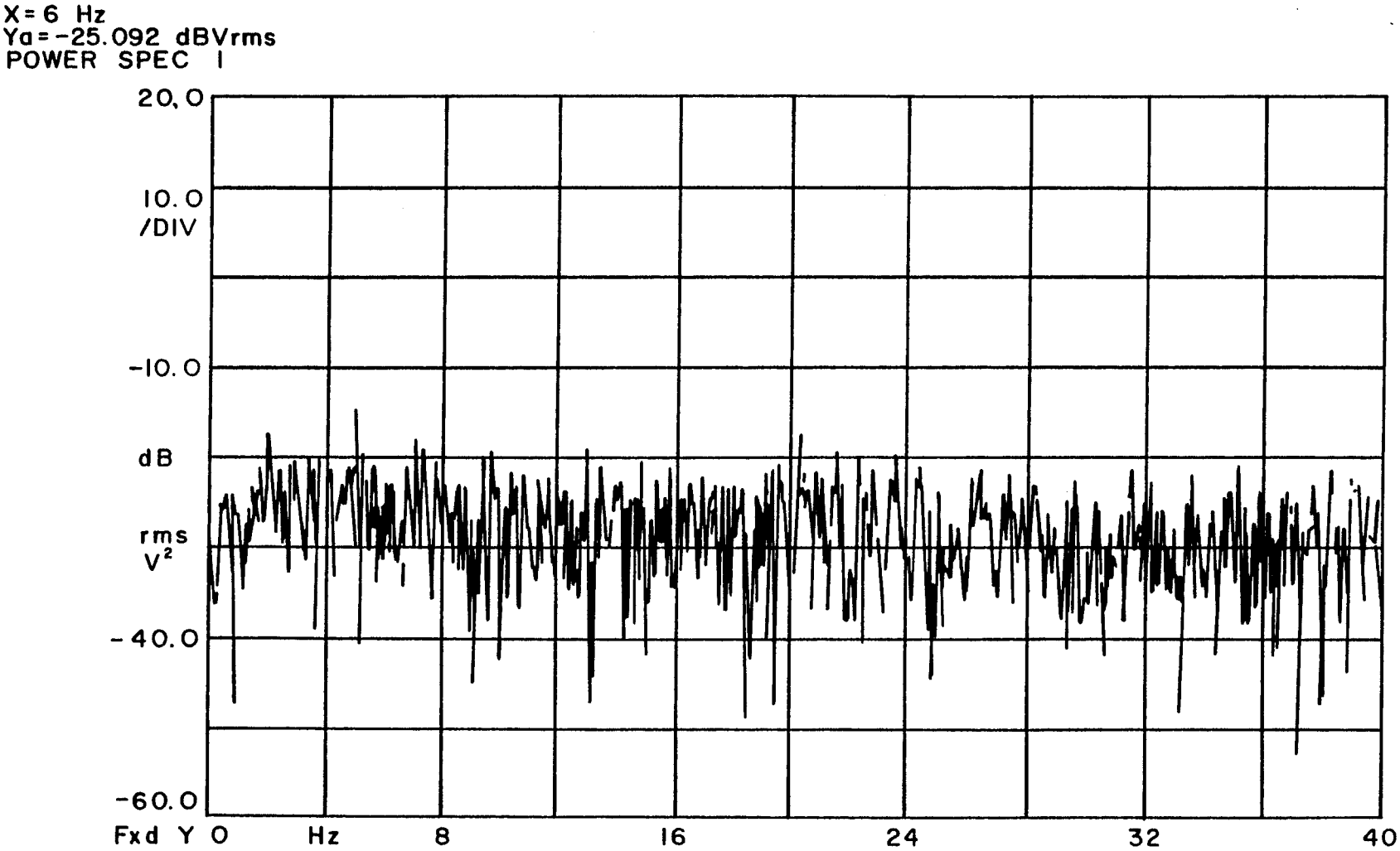

Test results of a real time sensed pressure pump noise signal are seen in FIG. 6*a*, where the amplitude of the signal as expressed in dB (in 10 dB increments) is plotted versus the frequency expressed in Hz (in 4 Hz increments). As seen in FIG. 6*a*, the noise signal includes several peaks having amplitudes between −10 dB and 0 dB, and even includes a peak having an amplitude exceeding 10 dB. The noise signal of FIG. 6*a* was then subjected to the noise cancellation procedure of FIG. 5. The noise signal remaining after mud pump noise cancellation is seen in FIG. 6*b*, and shows that the calibration and noise cancellation procedures reduced noise considerably. In fact, the largest remaining noise peak found at about 5 Hz, has an amplitude of approximately −15 dB, which is more than 25 dB less than the largest peak seen in FIG. 6*a* prior to noise cancellation.

Figure 7A:
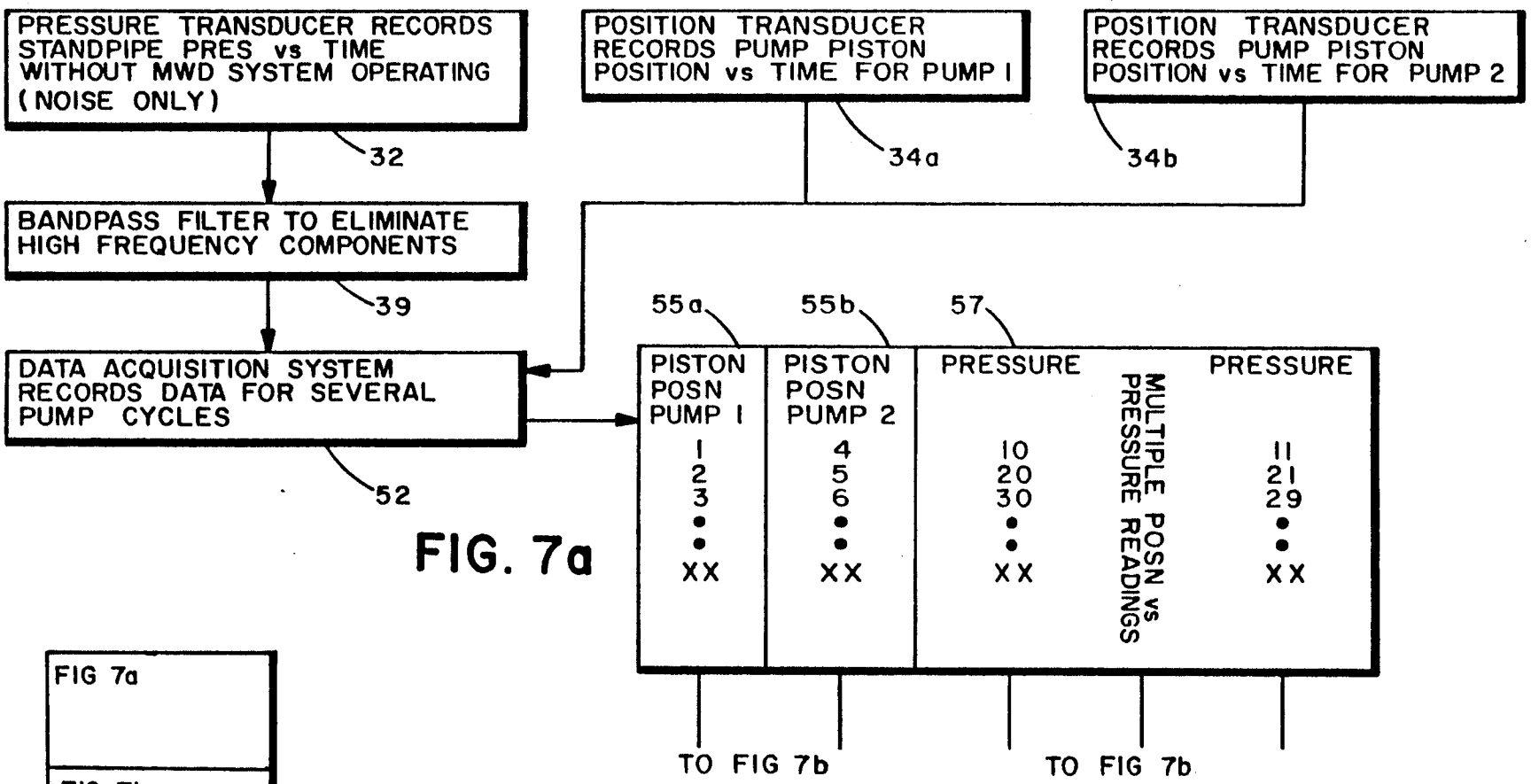
FIG. 7*a* and 7*b* together comprise a flow chart of the mud pump calibration procedure for a system utilizing multiple mud pumps.
Figure 7:
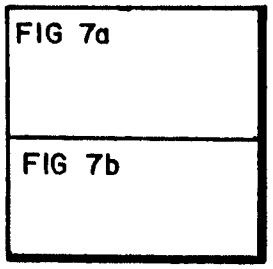
FIG. 7 is a diagram showing the relationship between FIGS. 7*a* and 7*b*.
Figure 7B:
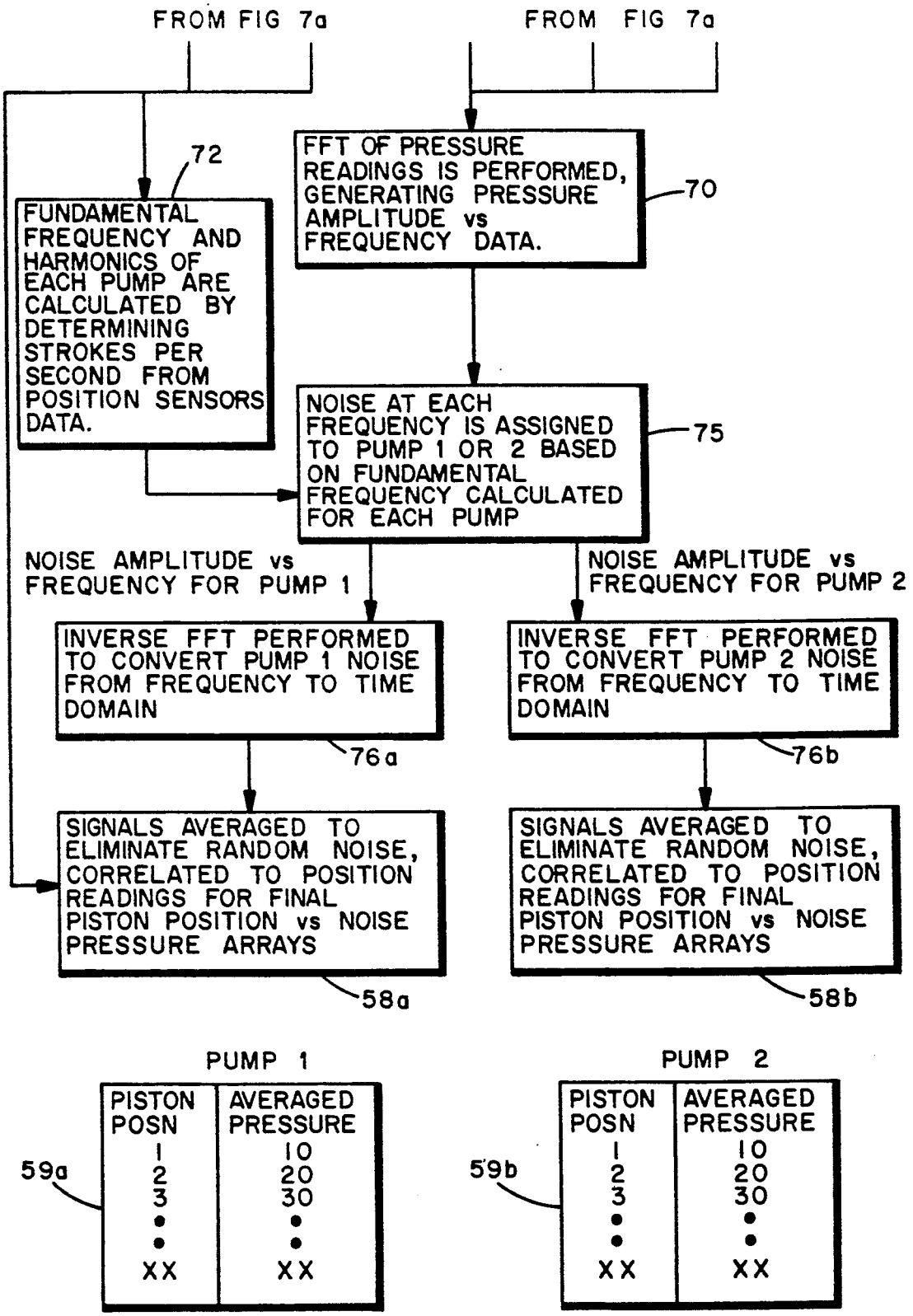
Figure 8A:
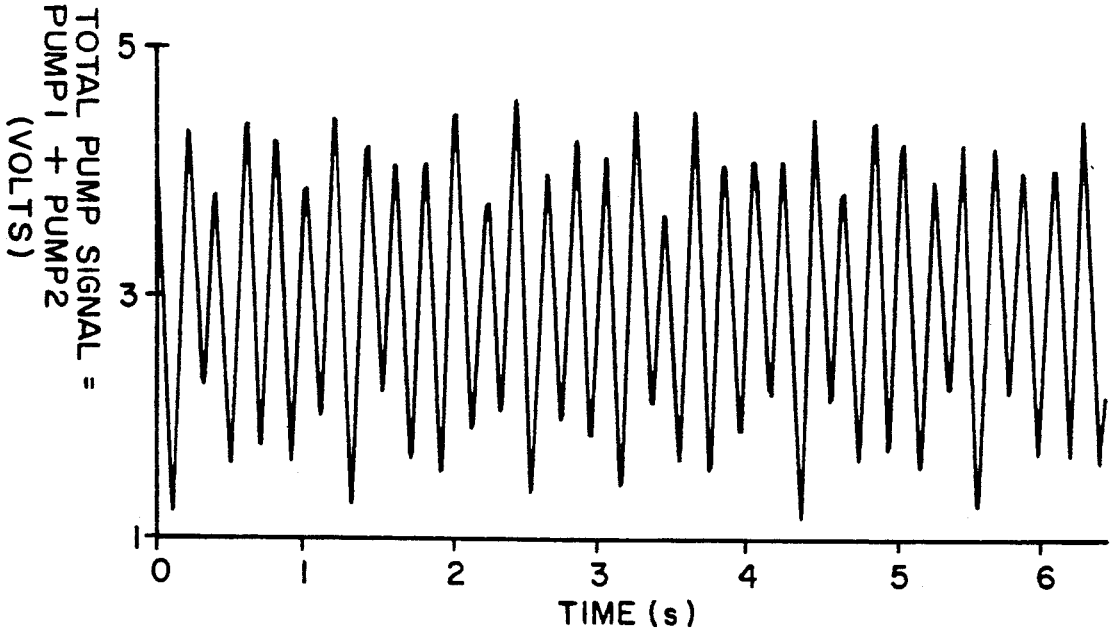
FIGS. 8*a*, 8*b*, and 8*c* are respectively the total pump signal, and the signals from pump one and pump two in the multiple pump system calibrated according to FIGS 7*a* and 7*b*.
Figure 8B:
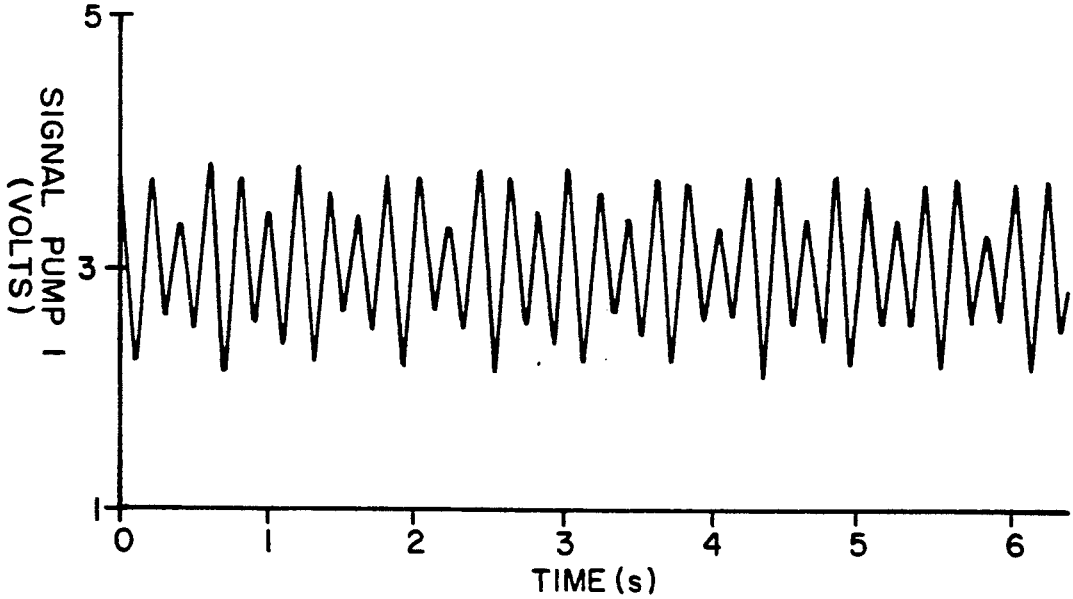
Figure 8C:
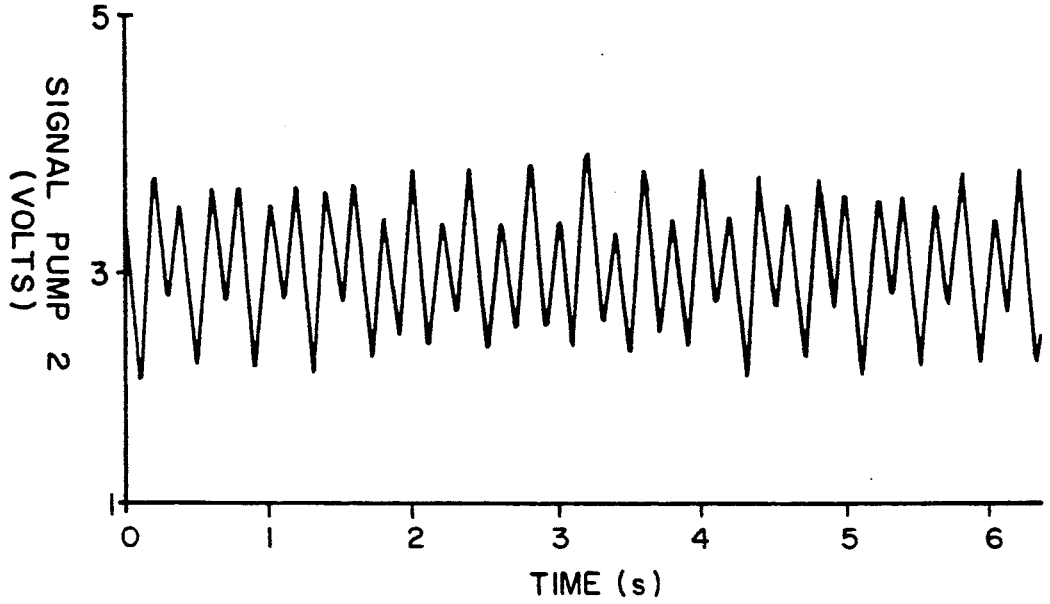
Figure 9A:
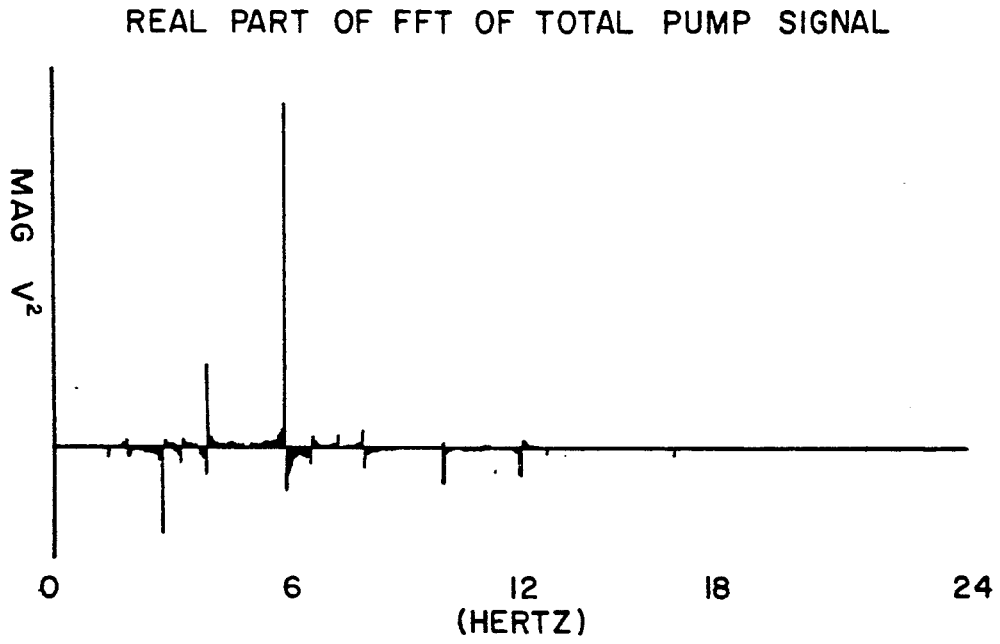
FIGS. 9*a*, 9*b*, and 9*c* are respectively the real parts of the signals of FIGS. 8*a*, 8*b*, and 8*c* as shown in the Fourier domain.
Figure 9B:
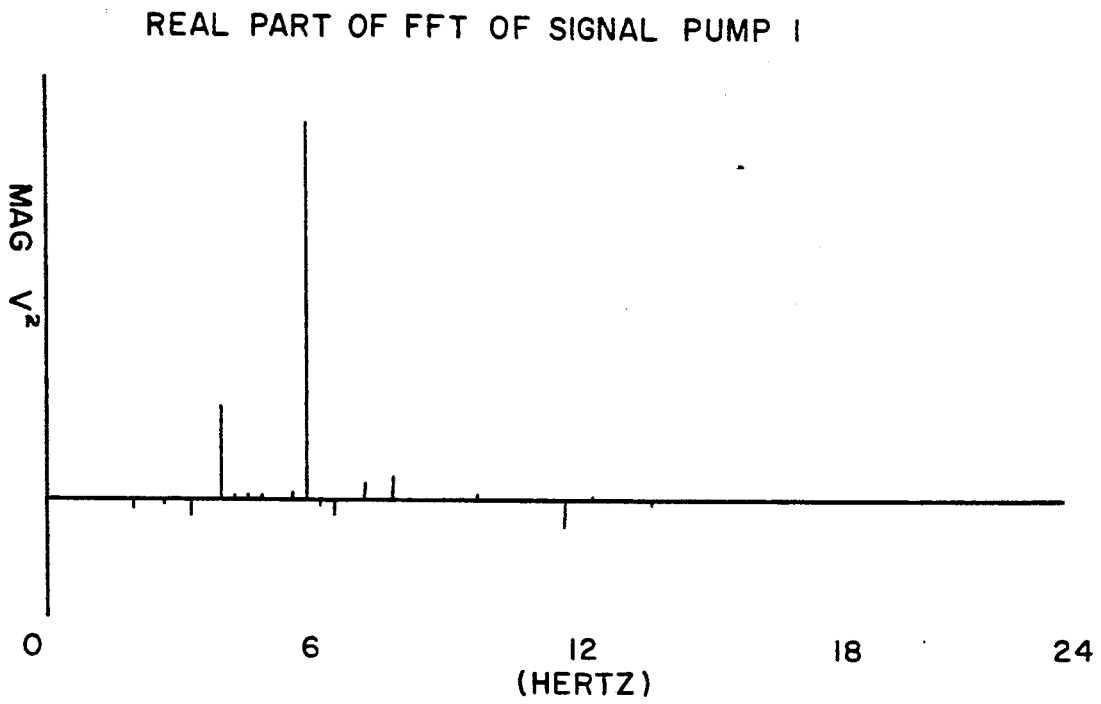
Figure 9C:
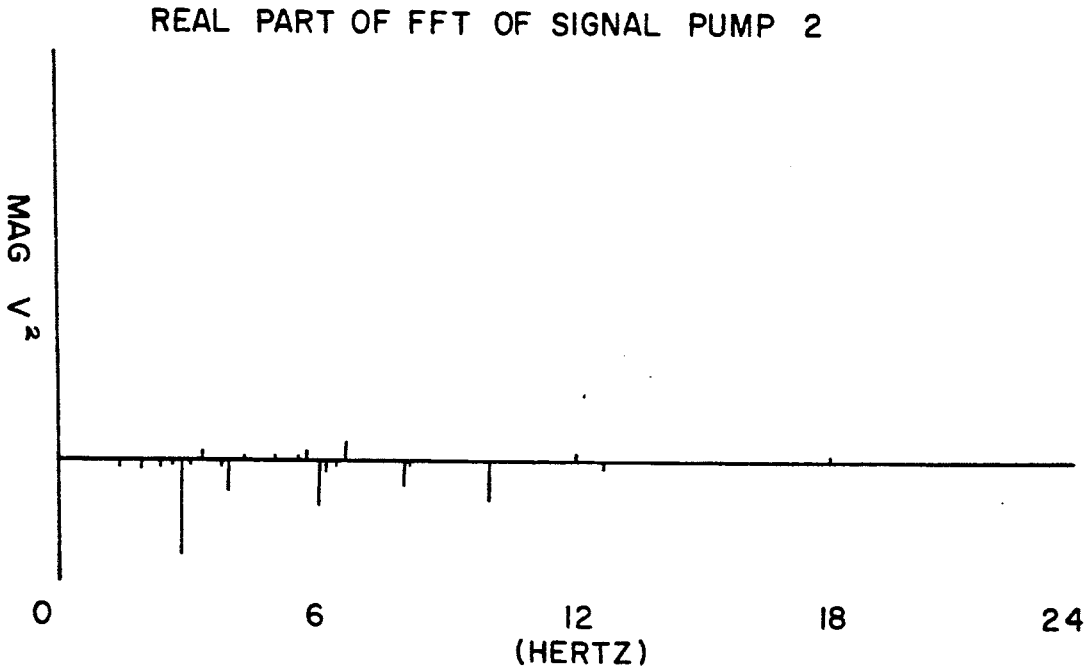

Turing to FIGS. 7, 7*a* and 7*b*, a flow chart of the mud pump calibration procedure for a system utilizing two mud pumps is seen. After the pump noise stabilizes in the system, and before the LWD tool turns on (i.e. before the data signal starts), the signals output by each position sensor 34*a*, 34*b* and the signal output by the pressure transducer 32 and filtered at 39 by a bandpass filter which measures composite pump noise are recorded as related position arrays 55*a*, 55*b* and pressure array 57 in the computer (e.g. in computer memory). Preferably, approximately twelve seconds of data are accumulated in computer memory at 52; FIG. 8*a* showing an example of the analog pressure signal which is digitized and stored as part of the array. A fast Fourier transform (FFT) of the composite pump noise signal is then conducted at 70 by the computer. As a result of the FFT, the amplitude and phase of all frequencies contained in the composite mud pump noise signal is obtained at 70 (see FIG. 9*a*). Utilizing the operating speed of each pump which can be computed from the position sensor of each mud pump, the fundamental frequency and harmonics for each pump are calculated at 72. The, at 75, the amplitude and phase information for each fundamental and harmonic frequency are extracted from the FFT and assigned to its source (i.e. a particular one of the mud pumps) to provide results as seen in FIGS. 9*b* and 9*c*. Taking an inverse Fourier transform of the frequency spectra of FIGS. 9*b* and 9*c* at 76*a* and 76*b*, signals attributable to each of the pumps are obtained as seen in FIGS. 8*b* and 8*c*. As indicated in FIG. 7*b* at 58*a* and 58*b*, the position of each mud pump position sensor is related to the mud pressure generated by the respective mud pump, and an average of the pressure as a function of position is calculated for each mud pump to produce two position vs. pump noise calibration arrays 59*a* and 59*b*. Indications of the average calibration arrays are stored in computer memory and used for canceling mud pump noise as is described above with reference to FIG. 10.

Figure 10:
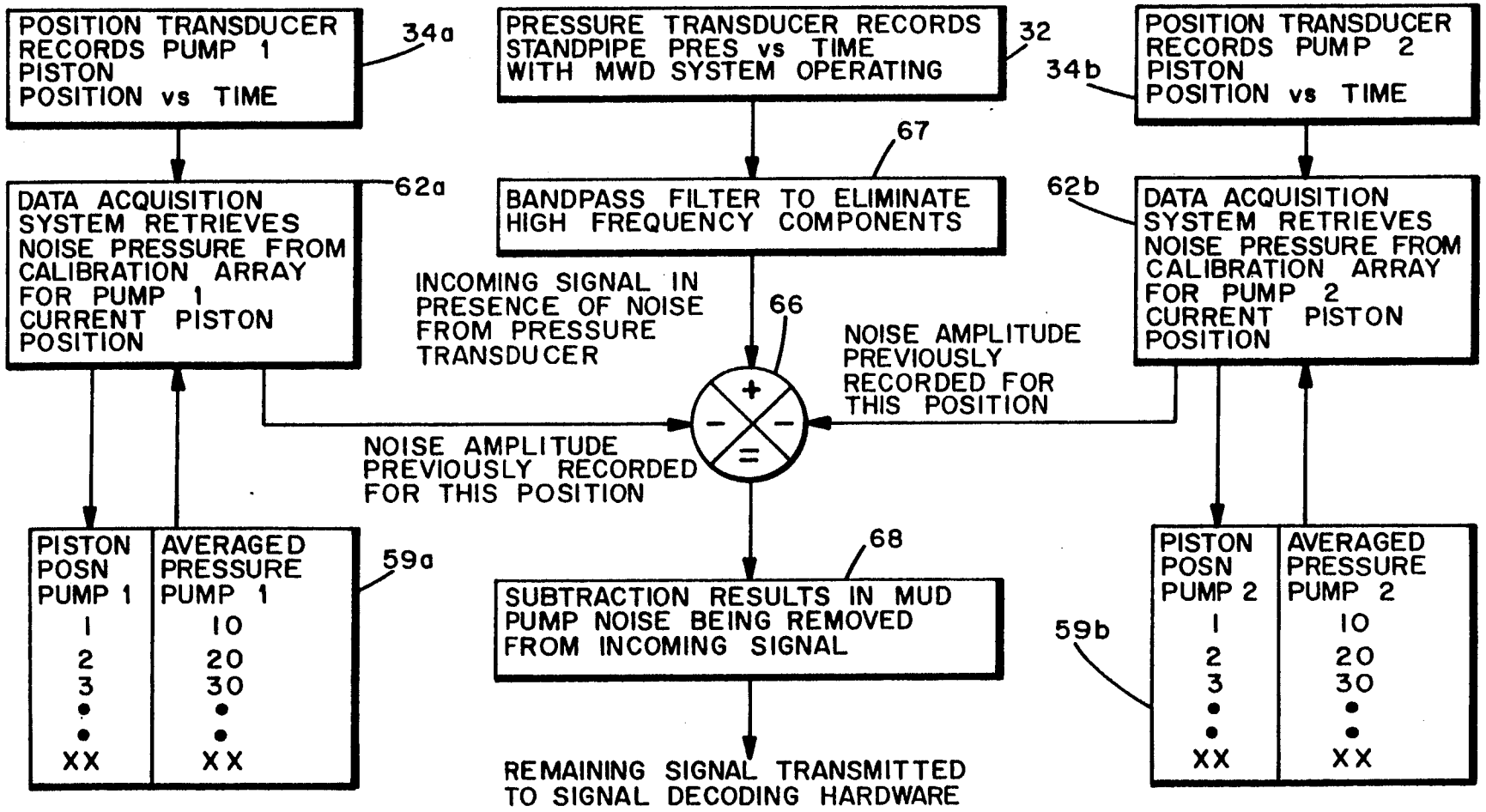
FIG. 10 is a flow chart of the noise cancellation procedure for a system utilizing multiple mud pumps.

Referring now to FIG. 10, the noise cancellation procedure for a system using multiple mud pumps is seen. Upon the turning on of the downhole tool and the transmission of LWD data, the position sensors 34*a* and 34*b* and pressure transducer 32 continue to provide indications of piston location and mud pressure; except that the piston position data is used in real time to determine the electrical signal (based on the calibration arrays 59*a* and 59*b*) which must be subtracted from the composite LWD/noise signal to cancel the noise component of the signal and leave only the LWD signal. Thus, as shown in FIG. 10, the position sensor signals are sampled at 62*a* and 62*b* (i.e. based on the position sensor signals, the average calibration arrays 59*a* and 59*b* are accessed and corresponding pump noises are provided), and the corresponding pump noise pressures 64*a* and 64*b* are subtracted at 66 from the real time sensed pressure 32 which was bandpass filtered at 67 to eliminate high frequency components. The difference between the real time sensed pressure and the pump noise pressures provides an indication of the LWD data signal 68. That signal is then decoded according to techniques known in the art which are not part of the present invention.

Figure 11A:
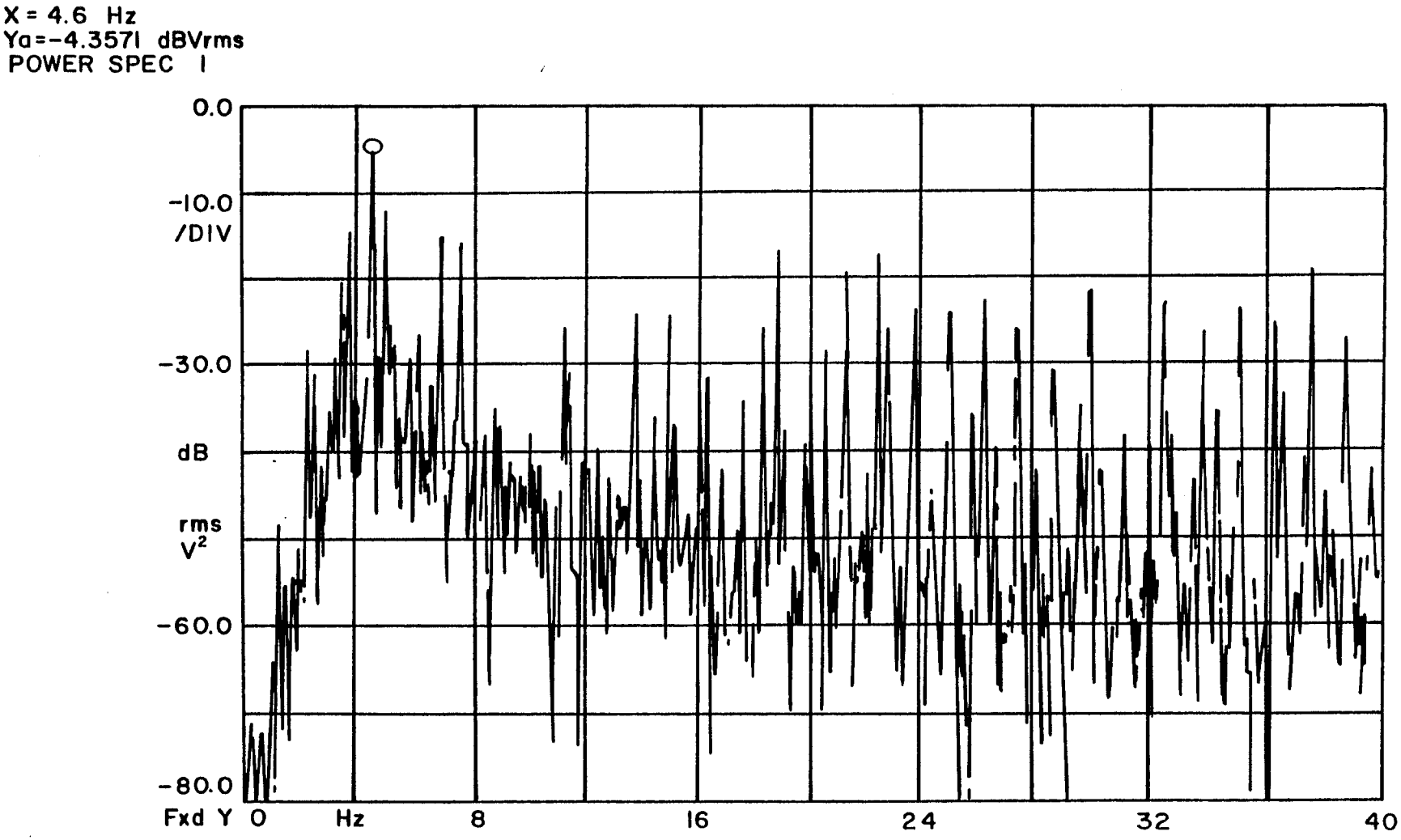
FIGS. 11*a* and 11*b* are respectively drilling mud signals prior to and after noise cancellation in a multiple pump system.
Figure 11B:
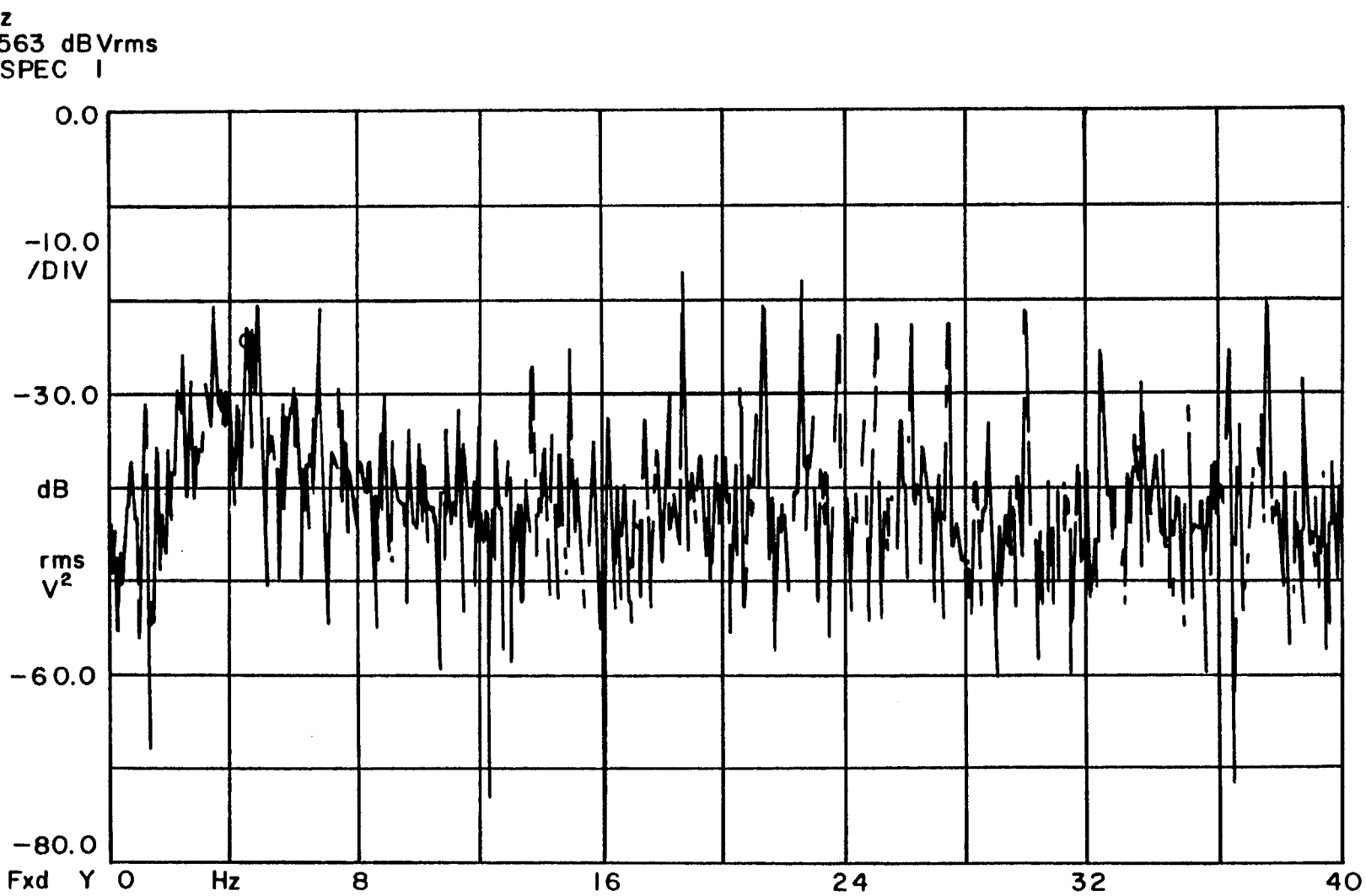

Test results of a real time sensed pressure containing pump noise for two mud pumps is seen in FIG. 11*a* where amplitude is plotted against frequency. As seen in FIG. 11*a*, numerous noise peaks having amplitudes of −20 dB or higher are seen, with the largest peak of about −5 dB at 5 Hz. The pressure signal obtained after utilizing the calibration and noise cancellation steps of FIGS. 7 and 10 in order to substantially cancel mud pump noise from the signal of FIG. 10*a* is seen in FIG. 10*b*. As seen in FIG. 10*b*, the remaining noise is substantially reduced relative to the noise of FIG. 10*a*, with the largest peak of about −18 dB occurring at approximately 18 Hz.

There have been described and illustrated herein methods and apparatus for canceling mud pump noise in order to recover a logging while drilling signal. While particular embodiments of the invention have been described it is not intended that the the invention be limited exactly thereto, as it is intended that the invention be as broad in scope as the art will allow. Thus, while particular pressure transducers, position sensors, pump-types, computers, FFT programs, and the like have been disclosed, it will be appreciated that other equipment and programs can be utilized effectively. Similarly, while certain preferred data gathering time periods were disclosed prior to running the LWD or MWD tool, it will be appreciated that other time frames could be utilized. Also, while the invention was described with reference to LWD and MWD procedures, it will be appreciated that the terms LWD and MWD are intended to include any other data signaling procedure where data is transmitted in drilling mud in the presence of mud pump noise. Further, while the invention was disclosed with reference to systems utilizing one or two mud pumps, it will be appreciated that the teachings equally apply to systems utilizing additional mud pumps. All that is required is that the pressure signature of each mud pump relative to its piston position be obtained via transforming the total signal into the Fourier domain, dividing the Fourier response among the various mud pumps based on their fundamental and harmonic frequencies, and converting the responses back into respective pressure signatures. It will be understood, of course, that where two mud pumps are working in unison (i.e. at the same frequency), their signatures can be treated together. Therefore, it will be apparent to those skilled in the art that other changes and modifications may be made to the invention as described in the specification without departing from the spirit and scope of the invention as so claimed.

We claim:

1. A method for recovering a data signal transmitted via drilling mud in the presence of mud pump noise created by at least one means for pumping said drilling mud, said method comprising:

(a) calibrating said at least one mud pump means by correlating first drilling mud pressure signals in the absence of said data signal with the piston positions of said at least one mud pump means to provide calibration information for each of said at least one mud pump means;

(b) during transmission of said data signal, sensing second drilling mud pressure signals, and for each mud pump means, tracking said piston position; and (c) based on said tracked piston position of each mud pump means, recovering said data signal by subtracting said calibration information from said second sensed drilling mud pressure signals.

2. A method according to claim 1, wherein said at least one mud pump means comprises a plurality of mud pump means, and said calibrating step further comprises processing the received mud pressure signals in the Fourier domain to allocate respective portions of said first drilling mud pressure signals to respective mud pump means such that each particular mud pump means is provided with calibration information relating the piston position of the particular mud pump means to drilling mud pressure signals created by the particular mud pump means.

3. A method for filtering a mud pressure signal being transmitted in mud to remove portions of said mud pressure signal generated by a mud pump means, comprising:

(a) running said mud pump means in the absence of a data signal being generated in said mud;

(b) recording first mud pressure signals as a function of mud pump piston position for said mud pump means in the absence of said data signal;

(c) running said mud pump means while said data signal is generated in said mud;

(d) recording over a given time period second mud pressure signals as a function of mud pump piston position for said mud pump means in the presence of said data signal;

(e) for each sampling point in time of said given time period relating to given pump piston positions, taking the difference between indications of the second mud pressure signal and indications of said first mud pressure signal recorded for an identical pump piston position to provide an indication of said data signal.

4. A method according to claim 3, further comprising:

obtaining a plurality of first mud pressure signals for each of said pump piston positions;

for each of said pump piston positions, averaging said plurality of first mud pressure signals, and providing therefrom average first mud pressure signals; and sorting indications of said average first mud pressure signals, wherein in said step of combining (step e), said indications of said average first mud pressure signals are used in lieu of said indications of said first mud pressure signal.

5. A method according to claim 4, further comprising:

A/D converting said recorded first mud pressure signals prior to averaging said plurality of first mud pressure signals, wherein said indications of said average first mud pressure signals are stored in digital form.

6. A method for filtering a mud pressure signal being transmitted in mud to remove portions of said mud pressure signal generated by a plurality of mud pumps means, comprising:

(a) running said plurality of mud pumps means in the absence of a data signal being introduced into said mud;

(b) recording first mud pressure signals as a function of mud pump piston position for each of said mud pump means in the absence of said data signal;

(c) processing said recorded first mud pressure signals in a Fourier domain to allocate respective portions of said first mud pressure signals to respective individual pump means of said plurality of mud pump means so as to generate processed signals relating pressure introduced by each individual mud pump means as a function of pump piston position of that individual mud pump means;

(d) running said plurality of mud pump means while said data signal is generated in said mud;

(e) recording over a given time period second mud pressure signals as a function of mud pump piston position for each of said plurality of mud pump means in the presence of said data signal;

(f) for each sampling point in time of said given time period relating to a given pump piston position for each of said plurality of pump means, taking the difference between indications of the second mud pressure signal and indications of said respective processed signals to provide an indication of said data signal.

7. A method according to claim 6, further comprising:

for each of said plurality of mud pump means, obtaining a plurality of processed signals for each of said pump piston positions;

for each of said plurality of mud pump means, for each of said pump piston positions, averaging said plurality of processed signals, and providing therefrom average processed signals; and storing indications of said average processed signals, wherein in said step of combining (step f), respective of said indications of average processed signals are used in lieu of said indications of respective processed signals.

8. A method according to claim 7, further comprising:

A/D converting said recorded first mud pressure signals prior to processing said first mud pressure signals, wherein said indications of average processed signals are stored in digital form.

9. A method according to claim 7, further comprising:

bandpass filtering first mud pressure signals prior to said recording step (b).

10. A method according to claim 6, wherein:

said processing step comprises

Fourier transforming said first mud pressure signals recorded over time to provide a frequency spectrum indication of said first mud pressure signals, dividing said frequency spectrum indication among said plurality of mud pump means to produce a separate frequency spectrum indication for each mud pump means, inverse Fourier transforming said separate frequency spectra to provide said processed signals.

11. A method according to claim 10, further comprising:

determining the fundamental frequencies of each of said plurality of mud pump means, wherein said step of dividing said frequency spectrum utilizes information regarding said fundamental frequency of each of said plurality of mud pump means.

12. In a system having a borehole tool which provides data signals through generating pressure variations in the drilling mud flowing through said system, and a mud pump means with at least one piston for pumping drilling mud in a mud line, said mud pump means causing mud pressure changes in the drilling mud flowing through said system as a function of its pumping cycle, a subsystem for recovering said data signals comprising:

(a) a mud pump piston phase detector means for tracking the position of said mud pump piston over time and for providing indications thereof;

(b) pressure sensing means coupled to said mud line for sensing the mud pressure in said mud line over time both when said borehole tool is and is not providing said data signals and for providing indications thereof;

(c) data storage means for recording indications of said mud pressure in said mud line sensed by said pressure sensing means over time as a function of said position of said mud pump piston of said mud pump means when said borehole tool is not providing said data signals; and (d) data processing means coupled to said data storage means, to said mud pump piston phase detector means, and to said pressure sensing means, for receiving said indications of mud pump piston position and said indications of said mud pressure when said borehole tool is providing said data signals, and using said indications along with said indications stored in said data storage means to provide a comparison of said mud pressure sensed over time by said pressure sensing means when said borehole tool is providing said data signals with mud pressure indications stored by said data storage means, said comparison being based on the position of said mud pump piston.

13. The subsystem of claim 12, wherein:

said indications stored in said data storage means are indications of averages or indications of the inverse of said averages of a plurality of mud pressures obtained when said borehole tool was not providing said data signals, each average or inverse average corresponding to a particular mud pump piston position.

14. The subsystem of claim 12, wherein:

said mud pump piston phase detector means comprises one of a linear position transducer and a rotary position transducer mechanically coupled to a rod of said mud pump piston.

15. The subsystem of claim 12, further comprising:

bandpass filter means coupled to said pressure sensing means, for bandpass filtering said indications provided by said pressure sensing means.

16. The subsystem of claim 15, further comprising:

means for converting bandpass filtered indications provided by said pressure sensing means and mud pump piston position indications provided by said mud pump piston phase detector means from analog into digital signals, wherein said indications stored by said data storage means relate to said digital signals.

17. In a system having a borehole tool which provides data signals through generating pressure variations in the drilling mud flowing through said system, and a plurality of mud pumps means each having at least one piston for pumping drilling mud in a mud line, said mud pumps means causing mud pressure changes in the drilling mud flowing through said system as a function of their pumping cycles, a subsystem for recovering said data signals comprising:

(a) for each said plurality of mud pump means, a mud pump piston phase detector means for tracking the position of said mud pump piston over time and for providing indications thereof;

(b) pressure sensing means coupled to said mud line for sensing the mud pressure in said mud line over time both when said borehole tool is and is not providing said data signals and for providing indications thereof;

(c) data processing means coupled to said pressure sensing means and to said plurality of mud pump piston phase detector means, for processing said indications of mud pressure which are obtained when said borehole tool is not providing said data signals, in a Fourier domain so as to determine how each of said plurality of mud pumps affects said mud pressure as a function of its mud pump piston position, and for providing second indications thereof;

(d) data storage means coupled to said data processing means for storing said second indications provided by said data processing means, wherein said data processing means further receives said indications of mud pump piston position for each said mud pump means and said indications of said mud pressure when said borehole tool is providing said data signals, and uses said mud pump piston position indications to access said second indications stored in said data storage means, and uses said second indications and said said indications of said mud pressure to provide an estimate of said data signals.

18. The subsystem of claim 17, wherein:

said mud pump piston phase detector means of each said mud pump means comprises one of a linear position transducer and a rotary position transducer mechanically coupled to a rod of said mud pump piston.

19. The subsystem of claim 17, further comprising:

bandpass filter means coupled to said pressure sensing means, for bandpass filtering said indications provided by said pressure sensing means.

20. The subsystem of claim 19, wherein:

for each said mud pump means, said indications stored in said data storage means are indications of averages or indications of the inverse of said averages of a plurality of mud pressures obtained when said borehole tool was not providing said data signals, each average or inverse average corresponding to a particular mud pump piston position of a particular mud pump means, and said subsystem further comprises means for converting bandpass filtered indications provided by said pressure sensing means and mud pump piston position indications provided by said mud pump piston phase detector means from analog into digital signals, wherein said second indications stored by said data storage means relate to said digital signals.

* * * * *